US006226939B1

(12) United States Patent
Atkins et al.

(10) Patent No.: US 6,226,939 B1
(45) Date of Patent: May 8, 2001

(54) DOWNLIGHTER COVER

(75) Inventors: Clive Anthony Atkins, Northants; Nigel Christopher Maris, Nr. Coventry, both of (GB)

(73) Assignee: Nullifire Limited (GB)

( * ) Notice: Subject to any disclaimer, the term of this patent is extended or adjusted under 35 U.S.C. 154(b) by 0 days.

(21) Appl. No.: 09/170,523

(22) Filed: Oct. 13, 1998

(30) Foreign Application Priority Data

Oct. 14, 1997 (GB) ..... 9721661
Nov. 28, 1997 (GB) ..... 9725152

(51) Int. Cl.[7] ..... E04B 1/94
(52) U.S. Cl. ..... 52/232; 52/28; 52/39
(58) Field of Search ..... 52/28, 39, 220.6, 52/232, 220.8, 506.06

(56) References Cited

U.S. PATENT DOCUMENTS 3,327,984 * 6/1967 Rennie ..... 52/28 X
3,864,883 * 2/1975 McMarlin ..... 52/232 X
4,419,535 * 12/1983 O'Hara ..... 52/232 X
4,751,031 * 6/1988 Baars ..... 52/232 X
4,758,003 * 7/1988 Goldstein et al. ..... 52/232 X
5,397,093 * 3/1995 Chubb et al. ..... 52/28 X

* cited by examiner

*Primary Examiner*—Christopher T. Kent
(74) *Attorney, Agent, or Firm*—Kilpatrick Stockton LLP

(57) ABSTRACT

The application discloses a fire protection cover for an electrical device recessed into a wall or ceiling, said, comprising one or more support layers coated with one or more layers of intumescent material. The device is especially useful for suspended ceilings or partition walls for preventing the passage of fire into or out of the ceiling or wall cavity. The cover may comprise one or more apertures to enable the cover to be ventilated and/or for access to cabling. In particular, the cover may be made of a mesh or perforated sheet.

In the event of a fire, the intumescent material tumesces to block any holes within the cover or holes between the cover and wall or ceiling.

11 Claims, 3 Drawing Sheets

DOWNLIGHTER COVER

The invention relates to a fire protection cover for a downlighter, audio speaker, fan, tannoy, alarm or similar insert into a false ceiling, such as a suspended ceiling, stud partitioned wall, etc.

Modern building methods commonly use suspended ceilings or partitioned walls which are supported below or separately from the main structure of the building. Typically a suspended ceiling comprises a membrane of tiles, panels or planks supported at a specific distance below an existing soffit by a grid of metal sections. Unless the suspended ceiling or partitioned wall is adequately protected from fire, the gap between the ceiling and wall and the structure of the building may provide a route for a fire to quickly spread from one part of a building to another. Suspended ceilings and partitioned walls should therefore be as fire proof as possible. Increasingly objects such as spotlights, porthole and recessed luminaires, smoke detectors, speakers, alarm systems and other such devices have been recessed within the suspended ceiling or partition. This requires an aperture to be made in the ceiling or partition which provides a route for fire to access the void between the ceiling or partition and the structure of the building. Furthermore, such devices tend to fall out of the suspended ceiling and/or partitioning wall in the event of a fire, thus providing access for the fire to the void.

It is known in the art to provide a tent of a fire blanket material to place over the luminaire or other inserted device. This provides a degree of fire protection and prevents, to some extent access of a fire to the void. A disadvantage of such a device is that such cover tends to be easily knocked out of position and may be lost or thrown away the luminaire or other device needs refitting. Furthermore, such a device does not stop the luminaire from dropping out in the event of a fire.

According in one aspect the invention provides a fire protection cover for an electrical device recessed into a wall, ceiling or the like, such as a downlighter, said cover comprising one or more support layers, which may be of metal, coated with one or more layers of intumescent material. Preferably the fire protection cover is substantially rigid.

The provision of such cover provides a more durable cover which is capable of being handled without being damaged.

The cover may be used in suspended ceilings, stud partitions and other situations where a wall or ceiling may be separated from the main structure of the building. It is also envisaged that such cover may be used in for example rail carriages, coaches, lorries or other forms of transport where recessed devices are fitted to a suspended ceiling or partition wall. The cover may be used for a variety of recessed devices such as spotlight and porthole luminaires, recessed luminaires, smoke detectors, speakers, alarms, fans and tannoy systems.

Preferably the fire protection cover of the invention comprises a base, one or more walls and an opening for receiving the electrical device. The opening for the electrical device and/or base may be substantially circular in shape. Alternatively the opening and/or base may be rectangular, square, or another shape so that the cover can be adapted to receive different inserted devices.

Preferably the or each wall tapers towards the base. The cover therefore may be substantially frustoconical in shape.

Alternatively the cover may comprise a cylindrical wall, a base at a first end of the cylindrical wall and an aperture for receiving the electrical device at the second end. This allows the cover to be simply manufactured from a sheet of material rolled to form the cylindrical wall and a pressed out sheet of material for the base. The base and wall may be held together by conventional methods such as welding or adhesive.

The base and/or one or more walls may comprise one or more apertures for the passage of cabling from the device, such as a downlighter, to pass through. Furthermore, there may be at least 1, especially 5 to 10 , most preferably 8, apertures to allow heat from the device to escape. This prevents the intumescent material from intumescing prematurely.

The base and/or one or more walls may also be in the form of a mesh or perforated sheet of material coated with one or layers of intumescent material. This allows full ventilation of heat from the device. The apertures in the mesh are closed by the intumescent material upon exposure to heat from a fire. "Perforated sheet" is intended to mean a sheet of material comprising a plurality of apertures substantially regularly placed across the sheet.

The apertures for the cabling and/or ventilation may be closed upon exposure to heat by the intumescing of the intumescent material. However, it is envisaged that further seals, such as intumescent rubber grommets may be provided to further seal the apertures upon exposure to heat. Such seals may also provide a degree of waterproofing to the fire protection cover.

The intumescent material may be an epoxy-, graphite-, mastic-, or water-based intumescent material of the type known in the art. Preferably it is applied in a thickness of ¼–1 mm especially ½ mm thickness to the or each layer of metal.

Preferably the or each layer of metal is steel, especially mild steel, or aluminium, with a thickness of between 0.5 mm and 1 mm. Preferably the metal is in the form of a mesh or perforated sheet.

The metal may be moulded into the desired shape before coating in the intumescent material. Water-based intumescent materials are especially suitable for such a method of application to the layer of metal. Such a process results in a layer of intumescent material on the outside and the inside of the fire protection cover.

The layer of metal may be pre-primed before coating with intumescent material to ensure good adhesion of the intumescent material to the cover.

Preferably the cover is attached to the downlighter or other device to be protected.

According to another aspect of the invention there is provided a fire protection shield for an electrical item, recessed into a wall, ceiling or the like, the shield comprising a cover arranged to receive the item, the cover carrying or being made of an intumescent material and further comprising means to attach the cover to an electrical item to be protected.

It may be attached by means or one or more rivets or screws, or be friction fitted. A device such as a downlighter may additionally be suspended from the base of the cover, for example by means of a threaded tube which is threadable onto the aperture for the cable in the base of the cover.

This gives the advantage that cover becomes an integral part of the downlighter or other inserted device and is less likely to be omitted or lost.

The cover and/or downlighter may rest upon the ceiling surrounding the aperture into which the downlighter or other device is inserted. Alternatively it may be attached to the ceiling and/or wall by means of one or more brackets or wire or metal stays attaching the cover to runners for the ceiling and/or partition. The fire protection cover may additionally be mounted on one side of a ceiling and/or partition wall and attached to a finishing ring which surrounds the aperture on the other side of the ceiling and/or partition wall. The cover may be attached to such a finishing ring by means or one or more brackets.

Upon exposure to heat the intumescent material will expand and help to fill any gaps between the ceiling and/or partition wall, thus preventing the entry of fire into the roof or wall voids. Further seals may be additionally provided between the cover and the ceiling, wall, downlighter or other inserted device, or the finishing ring. Such seals are preferably made of an intumescent rubber of the type known in the art, and provide further means to ensure that fire does not enter the ceiling and/or wall void. Such seals may also prevent the ingress of moisture.

The presence of intumescent material on the or each layer of material on the cover also ensures the prevention of the transmittal of heat. Upon exposure to heat the intumescent material will intumesce to between 10 to 50 times its original thickness. The expanded intumescent material will prevent transmittal of heat to the void of the ceiling and/or wall.

The invention will now be described by way of example with reference to the following figures.

Figure 1:
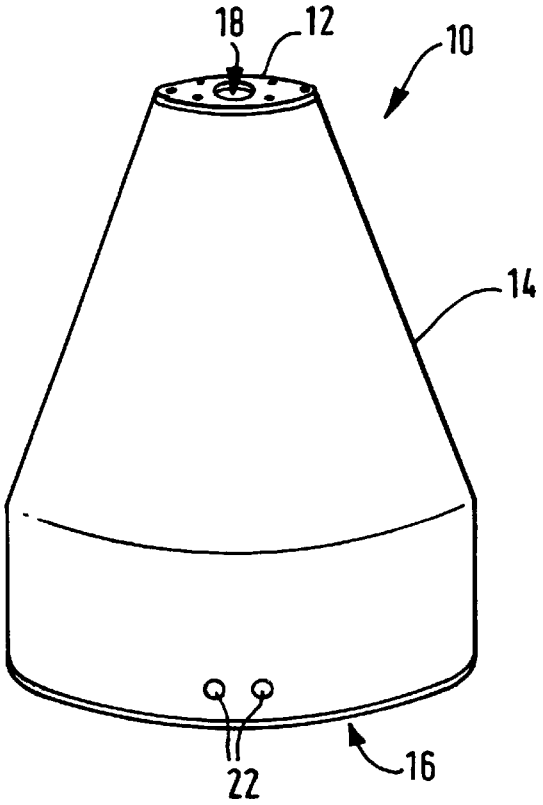
FIG. 1 shows a perspective view of a fire protective cover according to the invention.
Figure 2:
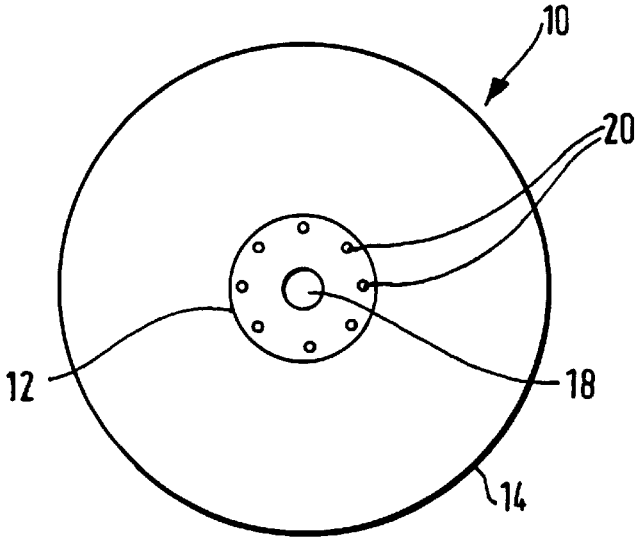
FIG. 2 shows a plan view from above of a fire protective cover according to the invention.

FIGS. 1 and 2 show a fire protection cover 10 comprising a base 12, wall 14 and an aperture 4 receiving a luminaire 16.

In this preferred embodiment the fire protection cover is substantially frustoconical in shape. However, the device may also be used with, for example, strip lights, in which case the cover will be substantially rectangular in plan view, but will preferably retain walls which taper towards the base of the cover. Other shapes to fit other recessed devices, such as speakers, fans or smoke detection devices may also be used.

An aperture 18 is provided for passage of a cable between the electricity supply and a luminaire when in use. Eight ventilation holes 20 are also provided in the base 12 to allow heat from a luminaire in use to dissipate. This prevents premature intumescing of the intumescent coating on the fire protection cover.

FIG. 1 also shows holes 22 for receiving a bracket for mounting the fire protection cover.

Fire protection cover 10 may be fabricated by welding or moulding a metal such as mild steel or aluminium. The fabricated metal is then dipped into an intumescent, such as a proprietary water-based intumescent material, for example S607 made by Nullifire Ltd., Coventry, United Kingdom, to produce the coated article.

Figure 3:
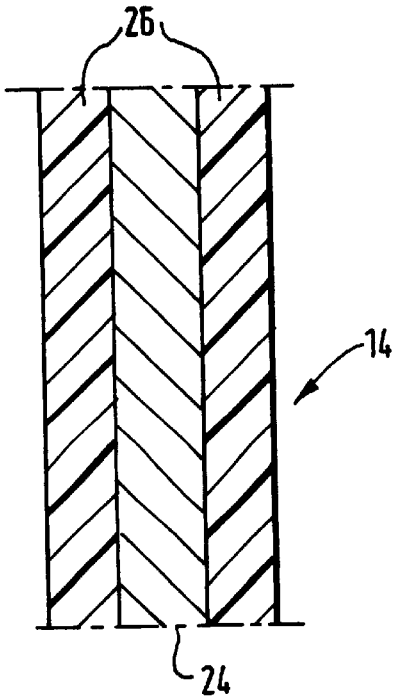
FIG. 3 shows a cross-section through a wall or a fire protective cover according to the invention.

FIG. 3 shows a cross-section through the wall 14 of a fire protection cover 10. It shows a layer of metal 24 coated with intumescent material 26.

The metal 24 may, if required, be coated with a primer before coating with an intumescent material 26. This may be done to improve the adhesion of the intumescent material to the metal.

Figure 4:
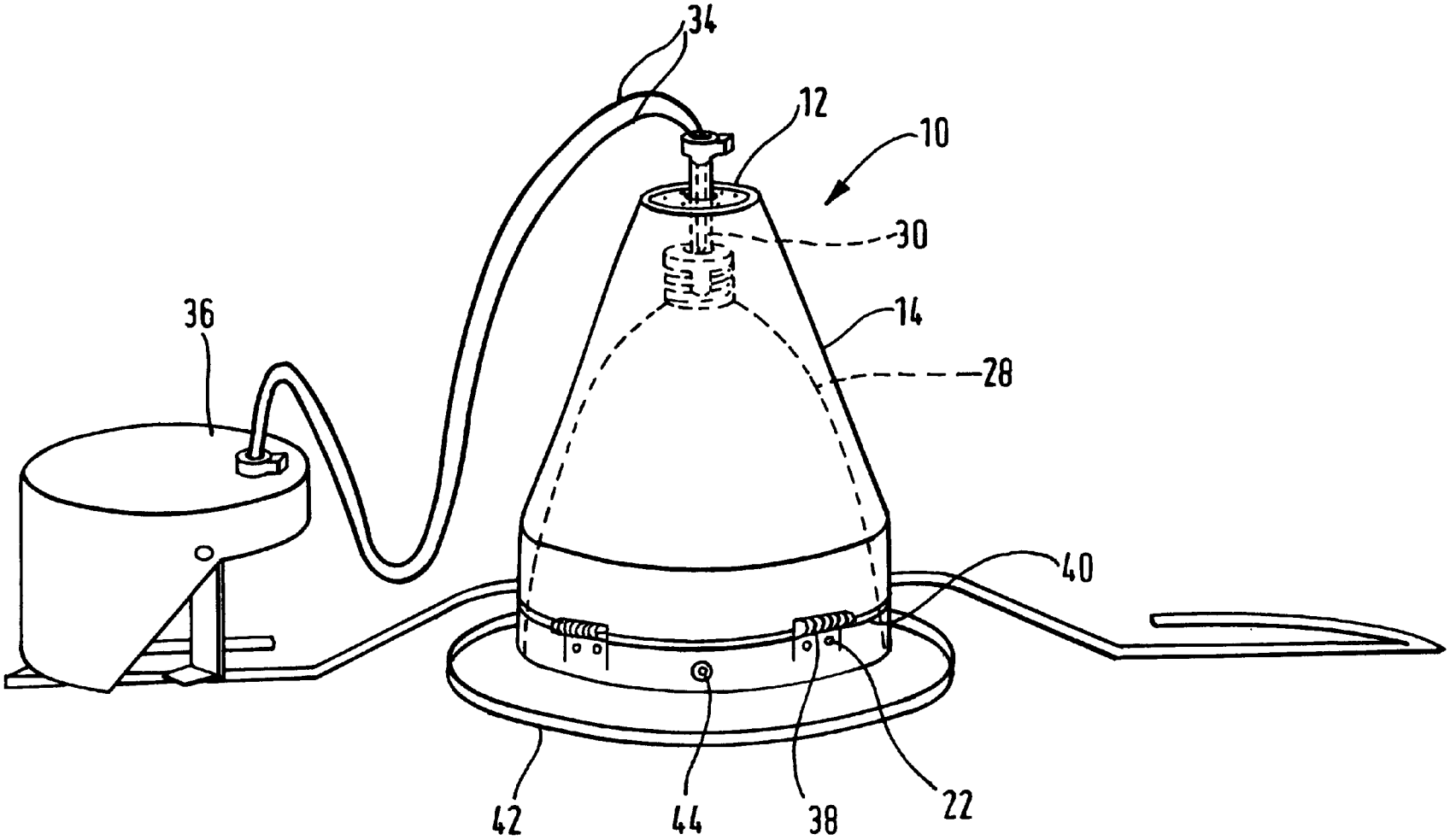
FIG. 4 shows a perspective view of a fire protective cover according to the invention in use with a luminaire.
Figure 5:
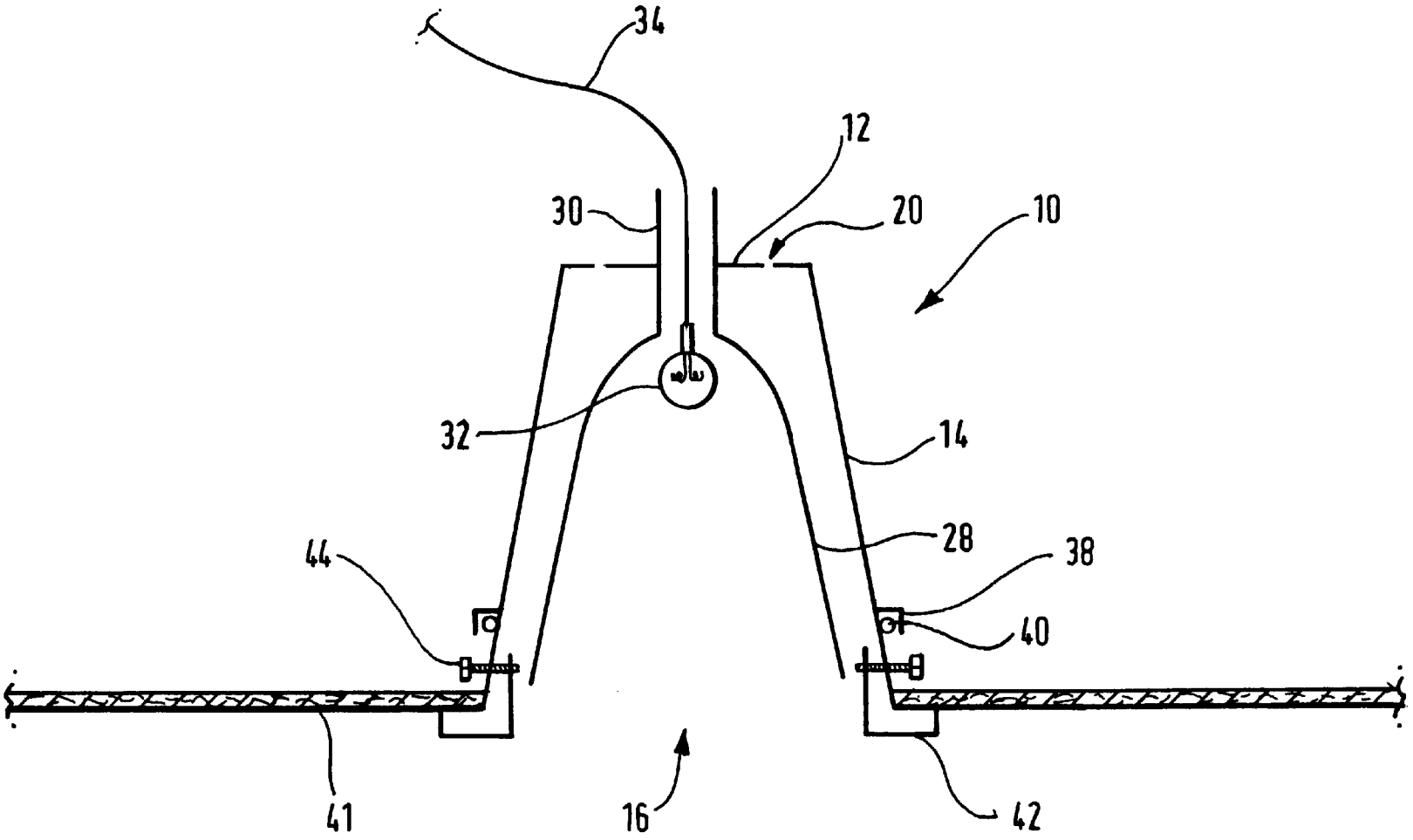
FIG. 5 shows a cross-sectional view of a fire protective cover according to the invention in use with a luminaire.

FIGS. 4 and 5 show the fire protection cover in use. Fire protection cover 10 is shown attached to reflector 28 (shown in ghost in FIG. 4) by a threaded tube 30. The threaded tube passed through the cable aperture 18 of the base 12 and is threaded onto the cover. This allows the position of the reflector 28 within cover 10 to be adjusted. A bulb 32 is provided within reflector 28. The cables 34 providing electricity to the bulb 32 pass through tube 30 to a junction box 36.

The cover 10 is provided with brackets 38 which are attached by means of rivets (not shown) through holes 22 in the cover 10. The assembly is supported in the embodiment shown by means of a wire support 40. The support passes substantially all of the way around the cover 10 and each end of the support 40 rests upon a support beam for the ceiling. The weight of the assembly is put onto the support 40 through brackets 38.

This means that the weight in total rests upon the support structure for the ceiling 41, rather than upon the individual tiles of the ceiling. This means that less stress is placed upon the tiles of the ceiling and means that the ceiling is more resilient to fire exposure.

The cover and reflector assembly is positioned above an aperture in the ceiling 41. A finishing plate 42 is attached to the cover 10 by means of screws 44. The finishing plate provides a good finish to the reflector/cover combination as well as providing a further seal to prevent the passage of heat and/or fire into the void above the ceiling.

It will be appreciated that the system is useful for other recessed equipment such as smoke alarms, speakers, tannoys, fans, etc.

It is envisaged that the invention may be used in both ceilings and partition walls.

The means of supporting the combined reflector and cover also includes resting the combination on the surrounding ceiling, directly mounting the fire protection cover by means of, for example, brackets, onto the wall and/or ceiling or suspending the weight of the cover from, for example, the structure of the building in which the cover is mounted.

In the event of a fire intumescent material 26 expands by up to 10–50 times its original thickness. This provides a seal between the individual components and prevents the passage of fire into the void of the ceiling. It is also envisaged that seals may be placed between the individual components and/or with the ceilings. The seal may be commercially available intumescent rubber material and has the further advantage of providing a moisture-proof seal.

What is claimed is:

1. A fire protection shield for an electrical item, recessed into a wall or ceiling, the shield comprising:

a cover adapted to be recessed into the wall or ceiling and arranged to receive the item, the cover carrying or being made of intumescent material operative to intumesce and form a seal in response to heat exceeding a certain temperature, said cover being frusto-conical or cylindrical in shape; and an element associated with the cover and operative to attach the cover to an electrical item to be protected.

2. A fire protection shield according to claim 1, wherein the cover further comprises a base, one or more walls extending from the base, and a surface of the wall or walls defining an opening for receiving said electrical device.

3. A fire protection shield according to claim 1, wherein the cover further comprises a surface defining one or more apertures for the passage of cabling through the cover and/or for providing ventilation of the cover.

4. A fire protection shield according to claim 1, the cover comprising one or more mesh or perforated sheet support layers coated with one or more layers of the intumescent material.

5. A fire protection shield according to claim 1, wherein the or each support layer comprises a metal layer.

6. A fire protection shield according to claim 2, wherein the wall forms a cylinder, the base is at a first end of the cylinder, and the surface defines the opening for receiving said electrical device at a second end of the cylinder.

7. A fire protection shield according to claim 1, additionally comprising one or more brackets or stays associated with the cover for attaching the cover to a ceiling and/or wall.

8. In combination, a fire protection shield, according to claim 1, attached to an electrical device for insertion into a wall or ceiling.

9. A fire protection shield according to claim 8, wherein the electrical device is a light fitting.

10. A fire protection shield for an electrical item, recessed into a wall or ceiling, the shield comprising:

a cover adapted to be recessed into the wall or ceiling and arranged to receive the item, the cover carrying or being made of intumescent material operative to intumesce and form a seal in response to heat exceeding a certain temperature, and the cover comprising one or more mesh or perforated sheet support layers coated with one or more layers of the intumescent material;

an element associated with the cover and operative to attach the cover to an electrical item to be protected.

11. A fire protection shield for an electrical item, recessed into a wall or ceiling, the shield comprising:

a cover adapted to be recessed into the wall or ceiling and arranged to receive the item, the cover carrying or being made of intumescent material operative to intumesce and form a seal in response to heat exceeding a certain temperature;

the cover further comprising a base, at least one wall extending from the base, and a surface of the wall defining an opening for receiving said electrical device;

the wall forming a cylinder, the base being at a first end of the cylinder, and the surface defining the opening for receiving said electrical device at a second end of the cylinder; and an element associated with the cover and operative to attach the cover to an electrical item to be protected.

* * * * *